United States Patent [19]

Tomita

[11] 4,023,377

[45] May 17, 1977

[54] DEFROSTING SYSTEM IN A COMPRESSION REFRIGERATOR

[75] Inventor: Shozo Tomita, Okayama, Japan

[73] Assignee: Kabushiki-Kaisha Nishinishon Seiki Seisakusho, Okayama, Japan

[22] Filed: Feb. 3, 1976

[21] Appl. No.: 654,902

[30] Foreign Application Priority Data

Feb. 5, 1975 Japan ..... 50-15919
Apr. 15, 1975 Japan ..... 50-50637

[52] U.S. Cl. ..... 62/196 B; 62/277
[51] Int. Cl.² ..... F25B 41/00; F25B 47/00
[58] Field of Search ..... 62/196 B, 277

[56] References Cited

UNITED STATES PATENTS

| | | | |
|---|---|---|---|
| 1,980,688 | 11/1934 | Lewis | 62/277 |
| 2,440,146 | 4/1948 | Kramer | 62/277 |
| 2,526,032 | 10/1950 | La Porte | 62/277 |
| 2,693,682 | 11/1954 | Winger et al. | 62/277 |
| 3,267,689 | 8/1966 | Liebert | 62/277 |
| 3,451,226 | 6/1969 | Shriver | 62/277 |
| 3,838,582 | 10/1974 | Redfern et al. | 62/196 B |

*Primary Examiner*—Lloyd L. King

[57] ABSTRACT

Disclosed is an improved defrosting system in a compression refrigerator. According to this invention there is provided a defrosting system in which the liquid-phase refrigerant is extracted from upstream of the expansion valve to a defrosting tank which is maintained at an elevated temperature high enough to cause the refrigerant to change from the liquid to vapor phase, and the now vapor-phase refrigerant is supplied to the evaporator where the refrigerant lose its heat in changing from the vapor to liquid phase, and the now liquid-phase refrigerant returns to the defrosting tank. The refrigerant circulates until the evaporator has been completely defrosted.

4 Claims, 2 Drawing Figures

DEFROSTING SYSTEM IN A COMPRESSION REFRIGERATOR

BRIEF SUMMARY OF THE INVENTION

This invention relates to a defrosting system for use in a compression refrigerator.

As is well known, in the compression refrigerator the compressor compresses the vapour-phase refrigerant and supplies the vapour at high pressure to the condenser where it parts with its heat and changes from the vapour to liquid phase. The now liquid-phase refrigerant under high pressure passes the expansion valve where it is expanded to the lower pressure, and the liquid-phase refrigerant under low pressure reaches the evaporator where it is evaporated to lower the temperature in the refrigerating compartment. The now vapour phase refrigerant is returned to the compressor. According to this invention there is provided a defrosting system in which the liquid-phase refrigerant is pulled out from upstream of the expansion valve to a defrosting tank which is maintained at an elevated temperature high enough to cause the refrigerant to change from the liquid to vapour phase, and the now vapour phase refrigerant is supplied to the evaporator where the refrigerant lose its heat in changing from the vapour to liquid phase, and the now liquid-phase refrigerant returns to the defrosting tank. The refrigerant circulates in the closed circuit including the defrosting tank and the evaporator until the evaporator has been completely defrosted. The defrosting tank is embedded in a heat reservoir and a serpentine heating pipe is embedded in the heat reservoir, too. The vapour phase refrigerant at high pressure flows from the compressor to the condenser via the serpentine heating pipe. The heat reservoir continuously stores the heat which the heating pipe parts with while the refrigerator works, thus keeping the defrosting tank at a raised temperature high enough to cause any refrigerant if supplied, to change from the liquid to vapour phase when the refrigerator is switched to the defrosting mode of operation.

Accordingly, an object of this invention is to provided an improved defrosting system for use in a compression refrigerator.

A defrosting system according to this invention comprises means for wetting and making the vapour phase refrigerant easy to lose its heat at the condenser of the refrigerator.

Accordingly, another object of this invention is to provide a defrosting system which prevents the overloading of the compressor in hot weathers of summer.

A defrosting system according to this invention comprises means for raising the inner pressure of the condenser, thus assuring the positive working of the compressor, and hence of the heating pipe and defrosting tank in combination.

Accordingly, still another object of this invention is to provide a defrosting system which functions well even in cold weathers of winter.

BRIEF DESCRIPTION OF THE SEVERAL VIEWS OF THE DRAWING

This invention will be better understood from the following description which is made with reference to the drawings.

DETAILED DESCRIPTION OF THE INVENTION

Figure 1:
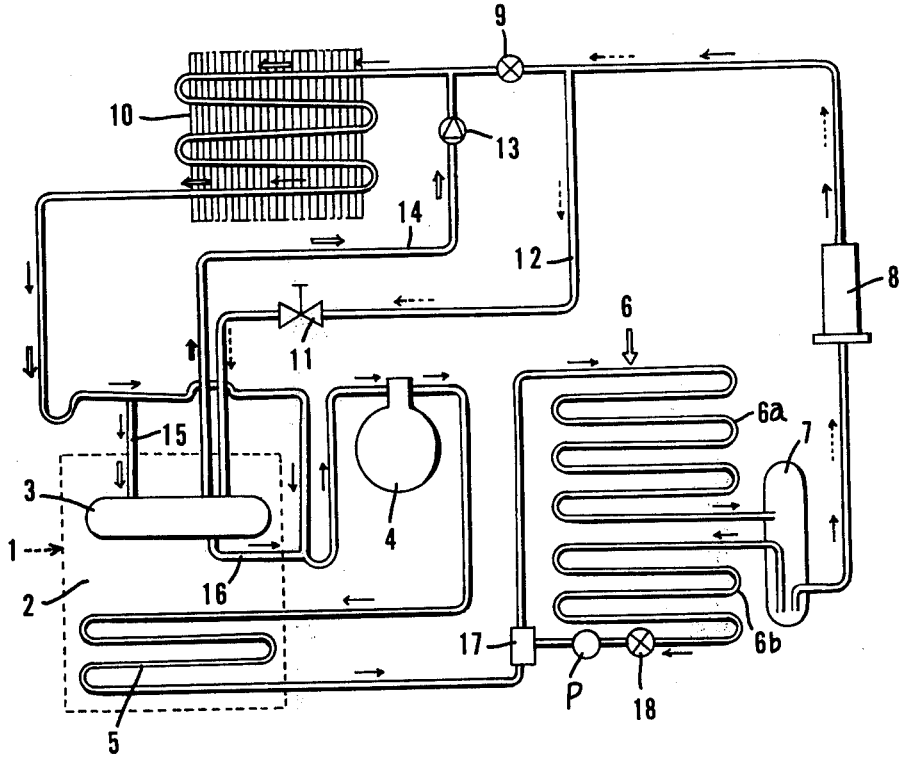
FIG. 1 shows a compression refrigerator in which a defrosting system according to this invention is installed.

Referring to FIG. 1, is a heat reservoir which is loaded with water, pumice or other proper material 2 of poor heat conductivity. A defrosting tank 3 and a coiled heating pipe 5 are embedded in the heat storing material 2. 4 is a compressor.

The upstream end of the heating pipe 5 is connected to the compressor 4, and the downstream end of the heating pipe 5 is connected to the condenser 6. The condenser 6 is connected to a liquid refrigerant vessel 7, which is connected to an expansion valve 9 via a drier 8. The upstream end of an evaporator 10 is connected to the expansion valve, and the downstream end of the evaporator is connected to the compressor 4.

The refrigerant starts from and returns to the compressor 4 via the heating pipe 5, the condenser 6, the liquid refrigerant vessel 7, the dryer 8, the expansion valve 9 and the evaporator 10. The refrigerant in either liquid or vapor phase under high pressure flows in the pipeline extending from the compressor to the expansion valve via the condenser, and hence this is herein called a high-pressure pipeline. In contrast to this the refrigerant in either phase under low pressure flows in the pipeline extending from the expansion valve to the compressor via the evaporator, and hence this is herein called a low-pressure pipeline. As shown in the drawing, according to this invention, the part of the high-pressure pipeline upstream and near the expansion valve 9 is connected to the defrosting tank 3 by a liquid refrigerant-supply pipe 12, which has an electromagnet valve 11. Likewise, the part of the low-pressure pipeline downstream and near the expansion valve 9 is connected to the defrosting tank 3 by a vapour refrigerant-supply pipe 14, which has a unidirectional check valve 13. An intermediate part of the flow path extending from the evaporator 10 to the compressor 4 is connected to the defrosting tank 3 by a liquid refrigerant-return pipe 15. The defrosting tank 3 is connected to the compressor 4, too.

In operation first, the compressor 4 is put in operation, and the vapour refrigerant thus compressed parts its heat with the heating pipe 5. Thus, the temperature of the padding material 2 in the heat reservoir 1 rises at 40° to 50°, centigrade.

The compressed refrigerant passes to the condenser 6 where it turns from vapour to liquid phase. The now liquid phase refrigerant drains in the vessel 7, and then it is dewatered when passing through the silicagel of the dryer 8.

After passing through the expansion valve 9, the refrigerant is evaporated, thus lowering the temperature of the evaporator in the freezer compartment. Finally, it returns to the compressor 4. When frost falls on the evaporator 10, the compressor 4 is put in inoperative position, and the electromagnetic valve 11 is automatically opened to allow the liquid-phase refrigerant in the high pressure pipeline to pass to the defrosting tank 3 via the liquid refrigerant-supply pipe 12, and then the electromagnet valve 11 is automatically closed.

The defrosting tank 3 in the heat reservoir 1 has been heated by the heating pipe 5 to such an elevated temperature that the so-supplied liquid-phase refrigerant evaporates in the tank, quickly. The now vapour-phase refrigerant passes through the unidirectional valve 13 to the evaporator 10. This vapour refrigerant is prevented from flowing back to the high pressure pipeline through the expansion valve 9. Thus, all the vapour-phase refrigerant from the defrosting tank 3 is supplied to the evaporator 10 via the vapour refrigerant-supply pipe 14, and when the refrigerant is changed from the vapour to liquid-phase, it heats the evaporator to remove the frost therefrom, and the now liquid-phase refrigerant returns back to the defrosting tank 3 via the return pipe 15, where the refrigerant again evaporates. This process will be repeated until the evaporator has been completely defrosted.

As shown in the drawing, the defrosting tank 3 is laid below the evaporator 10, and therefore the liquid-phase refrigerant falls in the tank by gravity through the return pipe 15. If desired, a pump may be provided to positively supply the liquid refrigerant to the tank through the return pipe 15.

When the frost has been completely removed from the evaporator 10, the temperature and pressure in the evaporator 10 rises to the same level as in the tank 3, and then no refrigerant will be reduced to liquid in the evaporator. Then, the compressor 4 is again put in operation to perform usual refrigeration.

As seen from the above, the compressed vapour flows from the compressor 4, and passes to the heating pipe 5, where it loses heat in the heat insulation material of the heat reservoir. Thus, the heat is stored in the reservoir until it raises the temperature of the heat insulation material surrounding the defrosting tank to such an elevated level that any refrigerant in the defrosting tank is changed from the liquid to vapour phase, and the now vapour-phase refrigerant flows to the evaporator and removes the frost from the evaporator in changing to the liquid-phase. This makes it unnecessary to use an extra heat source such as a coiled nichrome wire, and therefore a corresponding amount of electricity is saved. Advantageously, it is unnecessary to operate the compressor 4 in order to circulate the refrigerant in defrosting the evaporator 10. The circulation of the refrigerant in the closed circuit will stop automatically after the completion of defrosting. A pipe 16 is used to drain some oil content from the refrigerant. The unidirectional valve 13 may be replaced by an opening-and-closing valve, which is opened while defrosting, and is closed after defrosting.

As shown in FIG. 1, the condenser system 6 is consisted of a main condenser **6*a* and a sub-condenser 6*b*. The heating pipe 5 is connected to the upstream end of the main condenser 6*a* through an intervening ejector 17, and the downstream end of the main condenser is connected to the upper part of the reservoir 7. Likewise, the upstream end of the sub-condenser 6*b* is connected to the lower part or bottom of the reservoir 7, and the downstream end of the sub-condenser is connected to the sucking part of the ejector 17 via a flow rate control valve 18. If desired, a pump 19 is provided to the path between the control valve 18 and the ejector 17. The structure of the ejector is shown in FIG. 2.**

It is likely that the condenser 6 is at an elevated temperature in hot weathers of summer. Therefore, the heat is so difficult to dissipate at the condenser that there is the fear for overloading the compressor 4 in summer. If the flow rate control valve 18 is opened, the vapour-phase refrigerant when passing the ejector 17 will suck some liquid-phase refrigerant which is over-cooled in the sub-condenser **6*b* as mentioned later, thus wetting the vapour-phase refrigerant flowing from the heating pipe 5 to the main condenser 6*a*. As a result the refrigerant is put in a good thermal conductive condition. Therefore, even if the condenser is at an elevated temperature in hot weathers of summer, the heat will dissipate well at the condenser, and the vapour-phase refrigerant will condense well and it is supplied to the reservoir 7 in the liquid phase. Thus, the compressor 4 is prevented from overloading. The liquid-phase refrigerant flows from the resevoir 7 to the sub-condenser 6*b*,** where the refrigerant is over-cooled.

In contrast to the above, it is likely that the condenser 6 is at a lowered temperature in cold weathers of winter. If the flow rate control valve 18 is closed, the vapour-phase refrigerant which is dry and therefore is in a poor thermal conductive state, will be supplied from the heating pipe 5 directly to the main condenser **6*a*, thus raising the pressure under which the refrigerant condenses. Accordingly, the compressor 4 works under a relatively heavy load, and the heating pipe 5 produces a sufficient amount of heat to raise the temperature of the defrosting tank 3** in winter, thus assuring the positive performance in defrosting.

Figure 2:
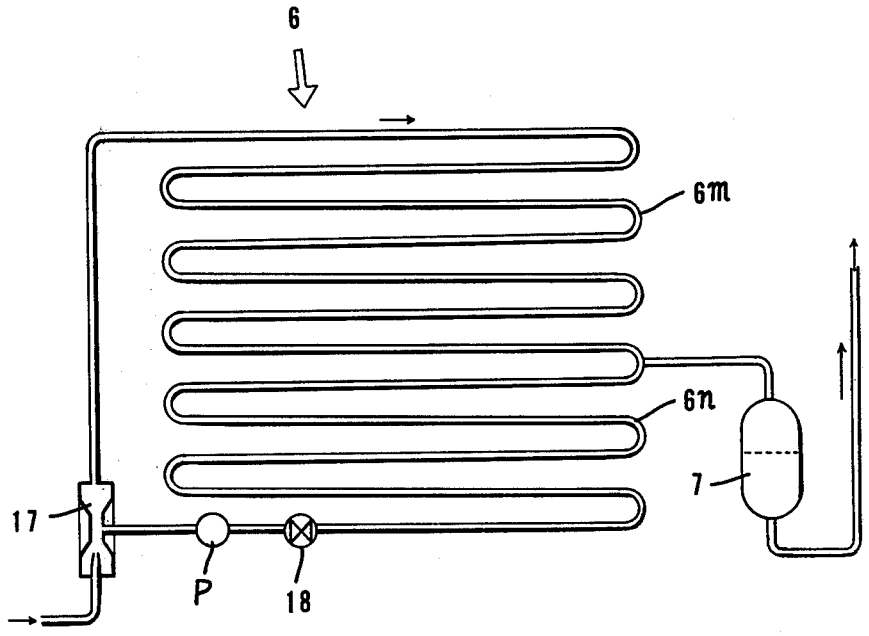
FIG. 2 shows a condenser which is different from the condenser of the compression refrigerator as shown in FIG. 1.

An alternative embodiment of condenser is shown in FIG. 2. The downstream end of the main condenser **6*m* is connected to the upstream end of the sub-condenser 6*n*, and the joint between the main condenser 6*m* and the sub-condenser 6*n* is connected to the top of the reservoir 7 so as to allow an overflowing amount of liquid-phase refrigerant to breed from the sub-condenser 6*n* to the reservoir 7.**

As seen from the above, in a defrosting system according to this invention the overloading of the compressor in hot weathers of summer is prevented by wetting and making the vapour-phase refrigerant easy to lose its heat at the condenser, and the positive working of the compressor in cold weathers of winter is assured by passing to the condenser the vapour-phase refrigerant which is dry and so difficult to lose its heat at the condenser and by accordingly raising the inner pressure of the condenser. Thus, the defrosting tank 3 is held at a raised temperature sufficient to assure the complete elimination of frost from the evaporator even in winter.

What is claimed is:

1. A defrosting system for use in a compression refrigerator having a high-pressure pipeline extending from a compressor to an expansion valve via a condenser and a low-pressure pipeline extending from said expansion valve to said compressor via an evaporator, said system comprising a defrosting tank connected to said high-pressure pipeline and means for periodically delivering liquid refrigerant thereto, said defrosting tank being connected to the inlet of said evaporator and to the outlet of said evaporator and inlet of the compressor so as to constitute a closed path in which a refrigerant vapour circulates, and a heating means to heat said defrosting tank at a raised temperature sufficient to cause any refrigerant when supplied to said defrosting tank to change from the liquid to vapour phase in said defrosting tank, the defrosting tank being located below the level of the evaporator to facilitate circulation of the refrigerant during a defrosting cycle.

2. A defrosting system according to claim 1 wherein said defrosting tank is connected to said high-pressure pipeline near and upstream of said expansion valve through a valve, which is adapted to open when some frost has fallen on said evaporator and to close after a given amount of liquid-phase refrigerant has been supplied to said defrosting tank, and said defrosting tank is connected to said evaporator through a unidirectional check valve, which allows the vapour-phase refrigerator to pass to the upstream inlet of said evaporator, and said heating means is composed of a heat reservoir and a serpentine heating pipe, which is connected between said compressor and condenser, said defrosting tank and said heating pipe being embedded in the heat insulating material of said heat reservoir.

3. A defrosting system according to claim 2 wherein it further comprises a liquid refrigerant vessel and an ejector, said condenser comprising a main condenser part and a sub-condenser part, the upstream end of said main condenser part being connected to said heating pipe through said ejector and the downstream end of said main condenser part being connected to the top of said vessel; the upstream end of said sub-condenser part being connected to the bottom of said vessel and the downstream end of said sub-condenser part being connected to said ejector.

4. A defrosting system according to claim 2 wherein it further comprises a liquid refrigerant vessel and an ejector, said condenser comprising a main condenser part and a sub-condenser part series-connected to each other, the joint between said main and sub-condenser parts being connected to said vessel and the upstream end of said main condenser part and the downstream end of said sub-condenser being connected to said ejector.

* * * * *